US005693601A

United States Patent [19]

Iakovides et al.

[11] Patent Number: 5,693,601

[45] Date of Patent: Dec. 2, 1997

[54] THICKENED AQUEOUS DETERGENT COMPOSITIONS WITH IMPROVED CLEANING PERFORMANCE WITH SHORT CHAIN SURFACTANTS

[75] Inventors: Panos Iakovides; Rita De Berardinis; Anna Lucia D'Orazio, all of Rome, Italy; Andrea Soddu, Uccle, Belgium

[73] Assignee: The Procter & Gamble Company, Cincinnati, Ohio

[21] Appl. No.: 583,108

[22] PCT Filed: Jul. 10, 1994

[86] PCT No.: PCT/US94/08089

§ 371 Date: Jan. 16, 1996

§ 102(e) Date: Jan. 16, 1996

[87] PCT Pub. No.: WO95/03383

PCT Pub. Date: Feb. 2, 1995

[30] Foreign Application Priority Data

| | | | |
|---|---|---|---|
| Jul. 23, 1993 | [EP] | European Pat. Off. | 93202186 |
| Nov. 22, 1993 | [EP] | European Pat. Off. | 93870222 |
| Jan. 10, 1994 | [EP] | European Pat. Off. | 94870002 |

[51] Int. Cl.[6] ..... C11D 1/75

[52] U.S. Cl. ..... 510/191; 510/225; 510/237; 510/427; 510/495; 510/503

[58] Field of Search ..... 510/191, 221, 510/225, 228, 237, 427, 433, 495, 496, 503

[56] References Cited

U.S. PATENT DOCUMENTS

| | | | |
|---|---|---|---|
| 3,892,669 | 7/1975 | Rapisarda et al. | 252/8.75 |
| 3,928,249 | 12/1975 | Nunziata et al. | 252/526 |
| 3,953,382 | 4/1976 | Nelson et al. | 252/548 |
| 4,282,109 | 8/1981 | Citrone et al. | 252/102 |
| 4,337,163 | 6/1982 | Schilp | 252/96 |
| 4,839,077 | 6/1989 | Cramer et al. | 252/98 |
| 5,055,219 | 10/1991 | Smith | 252/102 |
| 5,510,047 | 4/1996 | Gabriel et al. | 252/89.1 |
| 5,531,915 | 7/1996 | Perkins | 510/294 |
| 5,549,842 | 8/1996 | Chang | 510/191 |

FOREIGN PATENT DOCUMENTS

| | | | |
|---|---|---|---|
| 0 233 666 A1 | 8/1987 | European Pat. Off. | C11D 3/395 |
| 0 274 885 A1 | 7/1988 | European Pat. Off. | C11D 3/395 |
| 421738 | 4/1991 | European Pat. Off. . | |
| 2 003 522 | 8/1978 | Germany | C11D 1/75 |

*Primary Examiner*—Paul Lieberman
*Assistant Examiner*—John R. Hardee
*Attorney, Agent, or Firm*—Robert B. Aylor; T. David Reed

[57] ABSTRACT

The present invention is an aqueous liquid detergent composition comprising a short chain surfactant for improved cleaning performance. Said composition further comprises a mixture of long chain amide oxides to restore viscosity. Said composition provides outstanding soil removal when used as a dish pretreatment composition as well as outstanding cleaning performance when used in hard-surface applications including toilet bowl cleaning.

9 Claims, No Drawings

THICKENED AQUEOUS DETERGENT COMPOSITIONS WITH IMPROVED CLEANING PERFORMANCE WITH SHORT CHAIN SURFACTANTS

TECHNICAL FIELD

The present invention relates to thickened aqueous detergent compositions suitable for household application. More particularly, the compositions herein are suitable in hard-surface applications including toilet cleaning as well as in dishwashing applications, especially as a pretreatment composition.

BACKGROUND OF THE INVENTION

The liquid detergent compositions comprising the combination of long chain amine oxides and fatty acids are well known in the art.

It is desirable that such compositions have good cleaning properties. However, it has been found that long chain amine oxides do not provide the optimum cleaning performance. It is thus a first object of the present invention to provide cleaning compositions comprising long chain surfactants with improved cleaning.

In response to this object, it has been found that the incorporation of short chain surfactants is beneficial and meets this object thereby enhancing the cleaning performance. However, it has been observed that the incorporation of shod chain surfactants in such compositions results in the decrease of viscosity of the composition. Yet, it is considered essential that the compositions should exhibit a high degree of viscosity so that the compositions adhere to the vertical surfaces and surfaces inclined to the horizontal.

Thus, it is a further object of the present invention to provide a liquid composition which comprises long chain surfactants and short chain surfactants, which retains viscosity.

In response to this object, it has been found that viscosity may be retained even upon the addition of short chain surfactants, by the use of a specific mixture of amine oxides, more specifically a mixture of a $C_{14}$ chain amine oxide with a $C_{12}$ chain amine oxide, or a $C_{16}$ chain amine oxide or mixtures thereof.

A further advantage of the present invention is that there is no need for an additional thickening agent. An additional advantage of the compositions of the present invention is that they have a desirable sudsing profile such that suds suppressers are not required.

Thickening compositions comprising long chain amine oxides and fully saturated fatty acids are well known in the art.

U.S. Pat. No. 4,282,109 discloses a thickened bleach composition comprising hypochlorite and linear and branched long chain $C_{10}$–$C_{18}$ amine oxides as thickeners. There is no mention of short chain $C_6$–$C_8$ surfactants or fatty acids.

EP 274 885 discloses thickened bleaching compositions comprising alkali metal hypochlorite and straight chain $C_{14}$ amine oxide with a mixture of branched and straight chain $C_{15}$ amine oxide. There is no mention of short chain surfactants. The compositions may optionally contain fatty acids as an additional thickening aid.

EP 233 666 discloses a process for the manufacture of a thickened bleaching composition comprising hypochlorite, a hypochlorite-soluble surfactant and an alkali metal salt of a fatty acid. The detergent actives include amine oxides, preferably lauryldimethylamine. There is no mention of short chain surfactants.

DE 28 37 880 discloses bleaching compositions comprising alkali metal hypochlorite and mixtures of branched and linear amine oxides of varying chain length, ($C_5$–$C_{17}$) for increased viscosity. The compositions do not require fatty acids for thickening.

EP 30 401 discloses thickened bleaching compositions comprising hypochlorite and a certain number of product characteristics including pH and viscosity. Mixtures of $C_8$–$C_{18}$ amine oxides and fatty acids are preferred as thickening agents. There is no mention of short chain surfactants.

SUMMARY OF THE INVENTION

The compositions of the present invention comprise aqueous compositions having a viscosity of from 50 cps to 2000 cps comprising a mixture of long chain amine oxides according to the formula $R_1R_2R_3NO$ wherein $R_2$ and $R_3$ are independently $C_1$–$C_3$ alkyl groups, and a short chain surfactant.

Said short chain surfactant comprises a hydrophobic portion and a hydrophilic portion, wherein the chain length of said hydrophobic portion is $C_6$–$C_{10}$.

Said mixture of long chain amine oxides comprises a first amine oxide wherein $R_1$ is a $C_{14}$ alkyl group and a second amine oxide wherein $R_1$ is a $C_{12}$ alkyl group or a $C_{16}$ alkyl group, or mixtures thereof of said amine oxides.

The ratio of said first amine oxide to said second amine oxide wherein $R_1$ is a $C_{12}$ alkyl group is from 0.3 to 10, and the ratio of said first amine oxide to said second amine oxide wherein $R_1$ is a $C_{16}$ alkyl group is from 0.2 to 4.5.

All ratios, percentages and parts given herein are by % weight of the total composition unless otherwise specified.

The present invention further encompasses a process of treating dishes, wherein said dishes are contacted with a composition according to the present invention.

DETAILED DESCRIPTION OF THE INVENTION

The liquid detergent composition according to the present invention comprises a mixture long chain amine oxides and a short chain surfactant.

It has been found that the cleaning performance of the composition according to the present invention can be boosted by the incorporation of short chain surfactants.

The compositions according to the present invention comprise at least one short chain surfactant, or mixtures thereof. All surfactants have in common that they comprise a hydrophobic portion and a hydrophilic portion. By short chain surfactant, it is meant herein surfactants which comprise a $C_6$–$C_{10}$ alkyl chain as their hydrophobic portion. Such short chain surfactants are accordingly those conventionally used in this field, but with a shorter alkyl chain, and can be of any type. Accordingly, suitable short chain surfactants for use herein include $C_6$–$C_{10}$ alkyl sulphates ($C_6$–$C_{10}SO_4$), alkyl ether sulphates ($C_6$–$C_{10}(OCH_2CH_2)eSO_4$), alkyl sulphonates ($C_6$–$C_{10}SO_3$), alkyl succinates ($C_6$–$C_{10}OOCCH_2CH_2COOZ$), alkyl carboxylates ($C_6$–$C_{10}COOM$), alkyl ether carboxylates ($C_6$–$C_{10}(OCH_2CH_2)_eCOOM$), alkyl sarcosinates ($C_6$–$C_{10}CON(CH_3)R$), alkyl sulpho succinates ($C_6$–$C_{10}OOCCH(SO_3M)CH_2COOZ$), amine oxides ($C_6$–$C_{10}RR'NO$), glucose amides ($C_6$–$C_{10}CONR''X$), alkyl pyrrolidones ($C_6$–$C_{10}(C_4H_6ON)$, alkylpolysaccharides ($C_6$–$C_{10}OG_g$), alkyl alkoxylates ($C_6$–$C_{10}(OCH_2CH_2)e(OCH_2CH_2CH_2)_pOH$) and betaines ($C_6$–$C_{10}N^+(CH_3)_2CH_2COO$—). In the formulae in brackets, e and p are independently from 0 to 20 and e+p>0, Z is M or R, M is H or any counter ion such as those known in the art, including Na, K, Li, $NH_4$, amine, X is a polyhydroxyhydrocarbyl having a linear hydrocarbyl chain with at least 3 hydroxyls directly connected to the chain, or an alkoxylated derivative thereof, R, R' and R" are $C_1$–$C_5$ alkyl groups, possibly functionalized with hydroxyl groups, R and R' are preferably $C_1$–$C_3$, most preferably methyl, R" is preferably 2-hydroxyethyl or 2 hydroxypropyl, G is a saccharide, preferably glucose, and g is of from 1.5 to 8. All these surfactants are well known in the art. A more complete disclosure of conventional glucose amides can be found for instance in WO 92-06154 and a more complete disclosure of conventional alkyl polysaccharides can be found for instance in U.S. Pat. No. 4,536,319. The compositions according to the present invention may comprise any of the above surfactants alone, or any combination thereof, depending on the end use envisioned.

Preferred short chain nonionic surfactants for use herein are alkyl alkoxylates according to the formula $C_6$–$C_{10}$ $(OCH_2CH_2)e(OCH_2CH_2CH_2)_pOH$, where e and p representing respectively the degree of ethoxylation and propoxylation, are independently of from 0 to 20, and that e+p>0. Most preferred short chain nonionic surfactants for use herein are those where e and p are such that e+p is from 3 to 10, particularly those where p is 0 and e is from 3 to 8. Also, most preferred short chain nonionic surfactants for use herein are those where said short chain is a hydrocarbon chain comprising from 7 to 10 carbon atoms.

Said preferred short chain nonionic surfactants for use herein can be manufactured by the processes well known to the man skilled in the art, such as condensation of the corresponding alcohol and alkylene oxide, but such short chain surfactants are more conveniently commercially available for instance from Sidobre under the trade name Mergital@C4 (C8EO4), from Kolb under the trade names Imbentin@ AG/810/050 and AG/810/080 (respectively C8-10EO5 and C8-10EO8).

Preferred short chain anionic surfactants for use herein are $C_6$–$C_{10}$ alkyl sulphates ($C_6$–$C_{10}$SO4) and alkyl sulphonates ($C_6$–$C_{10}SO_3$). Most preferred are the C6–C8 alkyl sulphates and sulphonates. Such short chain anionic surfactants can be made by well known sulphation or sulphonation processes followed by neutralization, but said anionic short chain surfactants are more conveniently commercially available, for instance from Rhone Poulenc under the trade name Rhodapon@ OLS, or from Witco under the trade name Witconate@.

Preferred short chain surfactants for use herein are dimethyloctylamine oxide and octyl sulphate. Suitable short chain surfactants for use herein are preferably hypochlorite compatible. According to the present invention, the compositions comprise from 0.5% to 15%, preferably from 0.5% to 10%, more preferably from 1% to 6%,and most preferably from 2% to 4% by weight of the total composition of short chain surfactants.

It has been observed that the incorporation of short chain surfactants in compositions comprising typical amine oxides described in the art results in the decrease of said compositions viscosity. It has now been found that the viscosity of the compositions is not disturbed by the use of specific mixtures of long chain amine oxides.

According to the present invention suitable mixtures of long amine oxides for use herein are according to the formula $R_1R_2R_3NO$ comprising a first amine oxide wherein $R_1$ is a $C_{14}$ alkyl group and a second amine oxide wherein $R_1$ a $C_{12}$ alkyl group or wherein $R_1$ is a $C_{16}$ alkyl group or mixtures thereof. $R_2$ and $R_3$ are independently $C_1$ to $C_3$ alkyl groups in both said first and second amine oxides.

The ratio of said first amine oxide to said second amine oxide wherein $R_1$ is a $C_{12}$ alkyl group is from 0.3 to 10, preferably from 0.5 to 5 and wherein the ratio of said first amine oxide to said second amine oxide wherein in said second amine oxide $R_1$ is a $C_{16}$ alkyl group is from 0.2 to 4.5, preferably from 0.5 to 2.

Preferred long chain amine oxides for use herein can be Genaminox® LA, Gemaminox® MY-X (available from Hoechst), $C_{12}$–$C_{14}$ Aromox® DMMCO-W, (AKZO), Aromox DM14D-W, (AKZO) and Aromox DM14D-W (AKZO). Suitable long chain surfactants for use herein are preferably hypochlorite compatible. According to the present invention, said compositions comprise from 1.5% to 10%, preferably from 1.5% to 7% more preferably from 2% to 5% and most preferably from 2.5% to 4% by weight of the total composition of said mixture of long chain amine oxides of the present invention. Compositions according to the present invention comprise said mixture of long chain amine oxides so that compositions independently comprise from 0.4% to 6% by weight of the total composition of said first amine oxide, preferably from 0.5% to 4% and from 0.5% to 4% by weight of said second amine oxide, preferably from 0.5% to 3%.

The compositions according to the present invention comprise said mixture of long chain amine oxides and said short chain surfactants in a ratio of from 0.25 to 3, preferably 0.5 to 2.

The long chain amine oxide of the present invention restore the viscosity to a value of from 50 cps to 2000 cps, preferably from 100 cps to 700 cps, measured with a Brookfield viscosimeter RVT at a temperature of 25° C. using spindle numbers 2 or 3 or 4 at 50 r.p.m. or 100 r.p.m.

The compositions according to the present invention may further comprise as an optional ingredient other long chain surface active agents. Suitable long chain surface actives include alkyl sarcosinates, paraffin sulphonates, alkyl sulphates and alkyl ether sulphates.

A preferred optional ingredient is $C_{12}$ alkyl sulphate, the weight ratio of short chain surfactant to $C_{12}$ alkyl sulphonate being of 1:4 to 4:1.

Another optional component of the present invention is an alkali metal salt of a $C_8$–$C_{18}$ fatty acid. Suitable fatty acids for use herein can be any $C_8$–$C_{18}$ fatty acid, preferably fully saturated, preferably a sodium, potassium or lithium salt, more preferably the sodium salt. Suitable fatty acids may be selected from caprylic acid, capric acid, lauric acid, myristic acid, palmitic acid, stearic acid and mixtures of fatty acids suitably hardened, derived from natural sources such as tallow, coconut oil, ground oil and babassu oil.

Compositions according to the present invention comprise from 0.2% to 2%, preferably from 0.5% to 1% by weight of the total composition of fatty acids. Said fatty acids may be used as an additional thickening aid and as suds suppressers.

Another optional ingredient according to the present invention is a hypochlorite bleaching agent, preferably an alkali metal hypochlorite. Although alkali metal hypochlorites are preferred other hypochlorite compounds may also be used herein and can be selected from calcium and magnesium hypochlorite. Preferred alkali metal hypochlorite for use herein is sodium hypochlorite. Compositions according to the present invention comprise said hypochlorite bleaching agents such that the content of active chlorine in the compositions is from 0.4% to 4%, preferably from 1% to 2%. According to the present invention the ingredients of the compositions are selected so that the compositions are hypoclorite compatible.

An optional requirement of the compositions according to the present invention that the pH is greater than 12, preferably greater than 12.5, more preferably greater than 12.8. This is achieved by the addition of a caustic alkali. Suitable caustic alkalis for use herein include sodium and potassium hydroxide.

The compositions according to the present invention may also comprise a number of additional ingredients such as colourants and perfumes. Additionally, the compositions according to the present invention may comprise silicates used as corrosion inhibitors.

The compositions according to the present invention are prepared by methods well known in the art such as the methods described in GB 1 329 086. The compositions according to the present invention can be prepared by mixing all of the ingredients in a non-metallic apparatus at room temperature. Preferably, the surfactant blend is first prepared by adding the short chain surfactant to the long chain component. Perfume and the alkali metal hypochlorite are then added whilst stirring. Colourants are added after all the other ingredients have been mixed.

The compositions of the present invention may be used for a variety of cleaning purposes such as cleaning hard surfaces whereby said compositions thickened nature result in longer adhesion to the surface than non-thickened compositions. Said compositions are particularly suitable in the cleaning of inclined surfaces including toilet bowls.

In another embodiment of the present invention the compositions herein are used in dishwashing applications, including hand dishwashing as well as washing with automatic dishwashing machines. We have found that said compositions give particularly good cleaning performance, especially in terms of soil removal when used as a pretreatment composition for treating dishes especially pans, pots kitchen grills and/or any kitchenware soiled by though food stains/encrustations.

Accordingly the present invention encompasses a process of treating dishes which comprises the steps of contacting said dishes with a composition according to the present invention in its diluted or neat form, then allowing said dishes to remain in contact with said composition for a period of time sufficient to treat said dishes, preferably from 2 to 15 minutes, then rinsing said dishes in water to remove said composition. Said process mentioned herein may be followed by a subsequent step where said dishes are washed with a dishwashing product including the one of the present invention or any other coventional diswashing product. Indeed said subsequent step may be either a hand dishwashing operation or a dishwashing performed in automatic dishwashing machines.

Alternatively said process of treating dishes mentioned herein before can be preceded by a step where said dishes are soaked in water before being contacted with a composition of the present invention.

By "in its diluted form" it is meant herein that the compositions according to the present invention may be diluted with water. Typically dilution levels are of from 0.5% to 3% by weight of a composition of the present invention in water. Said dilution may occur before or while a composition of the present invention is applied to said dishes.

As used in the foregoing paragraphs, the expression "treating" includes washing as the compositions according to the present invention comprise surfactants and bleaching as the preferred compositions of the present invention comprise hypochlorite.

The compositions according to the present invention can be illustrated by the following examples.

| | A | B | C | D | E |
|---|---|---|---|---|---|
| C12 amine oxide | 1.0 | 1.0 | 0.6 | 0.7 | 1.3 |
| C14 amine oxide | 1.8 | 2.3 | 2.2 | 2.3 | 3.1 |
| C16 amine oxide | — | — | — | — | — |
| octyl sulphate | 1.5 | 2.0 | 2.0 | 1.0 | 3.0 |
| fatty acid | 0.5 | 0.5 | — | — | — |
| hypochlorite | 1.1 | 1.1 | 1.65 | 1.65 | 1.4 |
| sodium hydroxide | 0.8 | 0.8 | 1.3 | 1.3 | 1.1 |
| perfume | 0.15 | 0.27 | — | — | 0.2 |
| water + minors (balance) | | | | | |
| Viscosity, cps | 450 | 620 | 446 | 1600 | 1740 |

| | F | G | H | I | J |
|---|---|---|---|---|---|
| C12 amine oxide | — | — | — | — | — |
| C14 amine oxide | 1.5 | 0.5 | 1.9 | 1 | 1.5 |
| C16 amine oxide | 1.5 | 2 | 1.6 | 1 | 1.1 |
| octyl sulphate | 3 | 3 | 3 | 3 | 2 |
| fatty acid | 0.6 | 0.9 | 0.8 | 0.9 | 0.6 |
| hypochlorite | 1.6 | 1.7 | 1.5 | 1.6 | 1.7 |
| sodium hydroxide | 1 | 1 | 1.3 | 1.3 | 1.3 |
| perfume | 0.2 | 0.2 | 0.2 | 0.2 | 0.2 |
| water + minors (balance) | | | | | |
| Viscosity, cps | 130 | 80 | 300 | 100 | 450 |

| | K | L |
|---|---|---|
| C12 amine oxide | — | — |
| C14 amine oxide | 1.6 | 1.5 |
| C16 amine oxide | 1.5 | 1 |
| octyl sulphate | 3 | 3 |
| fatty acid | 0.9 | 0.9 |
| lauryl sulphate | 1.5 | 1 |
| hypochlorite | 1.5 | 1.70 |
| sodium hydroxide | 1.31 | 1.3 |
| perfume | 0.2 | 0.2 |
| water + minors (balance) | | |
| Viscosity(cps at 25° C.) | 300 | 100 |

| | M | N |
|---|---|---|
| C12 amine oxide | — | — |
| C14 amine oxide | 1.60 | 1.75 |
| C16 amine oxide | 1.50 | 1.50 |
| octyl sulphate | 3.00 | 3.00 |
| C12 alkyl sulphate | 1.50 | — |
| fatty acid | 0.90 | 0.50 |
| hypochlorite | 1.73 | 1.73 |
| sodium hydroxide | 1.30 | 1.30 |
| perfume | 0.275 | 0.275 |
| water + minors (balance) | | |
| Viscosity,cps | 100–500 | 100–500 |

| | O | P |
|---|---|---|
| C14 amine oxide | 6 | 4.5 |
| C16 amine oxide | 4 | 3 |
| octyl sulphate | 7 | 5 |
| C10 amine oxide | 3 | 2 |
| fatty acid | 1.2 | 0.9 |
| sodium hydroxide | 0.6 | 4 |
| perfume | — | 0.8 |
| water + minors (balance) | | |
| Viscosity,cps | 62 | 282 |

What is claimed is:

1. An aqueous composition having a viscosity of from 50 cps to 2000 cps comprising a mixture of long chain amine oxides according to the formula $R_1R_2R_3NO$ wherein $R_2$ and $R_3$ are independently $C_1$–$C_3$ alkyl groups, wherein said mixture of long chain amine oxides comprises a first amine oxide wherein $R_1$ is a $C_{14}$ alkyl group and a second amine oxide wherein $R_1$ is a $C_{12}$ alkyl group or a $C_{16}$ alkyl group, or mixtures thereof and wherein the ratio of said first long chain amine oxide to said second long chain amine oxide wherein $R_1$ is a $C_{12}$ alkyl group is from 0.3 to 10, and wherein the ratio of said first amine oxide to said second amine oxide wherein $R_1$ is a $C_{16}$ alkyl group is from 0.2 to 4.5 and wherein said composition further comprises 0.5 to 15% by weight of a short chain amine oxide of the formula $C_6$ alkyl $R_2R_3NO$.

2. An aqueous detergent composition according to claim 1, further characterized in that the ratio of said short chain amine oxide to said mixture of said long chain amine oxides is from 3 to 0.25.

3. An aqueous detergent composition according to claim 1, comprising from 1.5% to 10% by weight of the total composition of said mixture of long chain amine oxides.

4. An aqueous detergent composition according to claim 1 comprising from 0.5% to 15% by weight of the total composition of said short chain amine oxides.

5. An aqueous detergent composition according to claim 1, wherein said mixture of long chain amine oxides are selected from $R_1R_2R_3NO$, wherein $R_2$ and $R_3$ are methyl groups.

6. An aqueous detergent composition according to claim 1, further characterized in that said composition comprises an alkali metal hypochlorite.

7. An aqueous detergent composition according to claim 6, having a pH of above 12.5.

8. An aqueous detergent composition according to claim 1 which further comprises a $C_{12}$alkyl sulphate.

9. A process of treating dishes which comprises the steps of:

contacting said dishes with a composition according to any one of claims 1 through 9 in its neat or diluted form, then allowing said dishes to remain in contact with said composition for a period of time sufficient to treat said dishes, then rinsing said dishes in water to remove said composition.

* * * * *